United States Patent [19]

Wlodkowski et al.

[11] 4,388,014

[45] Jun. 14, 1983

[54] MULTIPLE PART TAPERED COLLAR FOR A TENDON ANCHORAGE SYSTEM

[75] Inventors: Johann Wlodkowski; Dieter Jungwirth, both of Munich, Fed. Rep. of Germany

[73] Assignee: Dyckerhoff & Widmann Aktiengesellschaft, Munich, Fed. Rep. of Germany

[21] Appl. No.: 227,597

[22] Filed: Jan. 23, 1981

[30] Foreign Application Priority Data

Jan. 26, 1980 [DE] Fed. Rep. of Germany ..... 3002846

[51] Int. Cl.[3] ..... B25G 3/20; F16B 2/00; F16B 7/04

[52] U.S. Cl. ..... 403/369; 403/374

[58] Field of Search ..... 403/369, 374, 409, 373, 403/314; 52/223 L, 230

[56] References Cited

U.S. PATENT DOCUMENTS 3,515,794 6/1970 Beinhaur et al. ..... 403/369 X 3,868,748 3/1975 Kelly ..... 403/369 X

*Primary Examiner*—Wayne L. Shedd

*Attorney, Agent, or Firm*—Toren, McGeady and Stanger

[57] ABSTRACT

A multiple part tapered collar for use in a wedge anchoring system for a tendon in a structural concrete member usually consists of three coextensive elongated parts combined to form an axially extending annular component. The inner surface of the collar bears against the surface of the tendon, for instance, a wire, rod or the like, and its outer surface contacts the surface of a frusto-conical bore in an anchoring member. A groove is formed along the axial length of the outer surface of at least one of the parts of the collar for passing neat cement or a similar substance for enclosing the tendon. As a result, openings through the anchoring member, which are expensive to form and tend to clog, are unnecessary.

3 Claims, 3 Drawing Figures

MULTIPLE PART TAPERED COLLAR FOR A TENDON ANCHORAGE SYSTEM

SUMMARY OF THE INVENTION

The invention relates to a multiple part, tapered collar for use in a wedge anchoring system for anchoring a tendon in a structural concrete member with the inner surface of the parts of the collar bearing against the tendon, which may be a wire, a strand or the like, and with the outer surface of the parts in contact with the surface of a frusto-conical bore in an anchoring member.

Tapered collars of this type are used for anchoring the prestressing wires, rods or strands in a prestressed concrete member. While they may consist of two parts, usually they are formed of three parts, with the parts forming radially and longitudinally extending joints in the collar held together by a spring ring inserted into a circumferential groove around the outer surface of the collar. On the inside surface facing toward the prestressing member, the collars usually are profiled with teeth which dig into the prestressing member to prevent slippage as much as possible when the prestressing member is released after being prestressed.

In prestressed concrete members, the tendons are guided through sheathing tubes so that the prestressing action can be performed after the concrete has set. Following the prestressing action, the space between the tendon and the sheathing tube is filled with neat cement or grout to provide a bond between the tendon and the surrounding concrete and also to protect it from corrosion. In such an arrangement, it is known to place an injection cap on the outer surface of the anchorage system after the tendons have been stressed, so that the neat cement can be injected through the cap into ducts or passages formed in the anchoring member.

The use of ducts or passages in the statically highly stressed anchoring member presents problems in its production as well as in the stresses and strains developed within the member. Therefore, the primary object of the present invention is to provide the possibility of injecting the neat cement or other material in another manner.

In accordance with the present invention, at least a portion of the tapered collar fitted within the anchoring member is provided with an axially extending groove through which the neat cement or similar material can be injected around the tendon.

Elongated axially extending grooves can be located in the outer surface of the individual parts which make up the collar. Advantageously, the grooves are formed by recesses provided along the edges of adjoining surfaces of the individual parts of the collar, that is, along the surfaces disposed in facing relation.

One advantage of the invention is that the required cross-sectional area for the passage of the neat cement is provided by widening the collar slots in the outer region of the collar. As a result, it is unnecessary to form recesses in the anchoring member which recesses are expensive to produce and have a tendency to clog. The widened slots do not extend over the full thickness of the collar, accordingly, the load bearing characteristic of the individual collar parts is not impaired. As a result of the arrangement of the collar parts embodying the present invention, it is possible to avoid locating two collar slots closely together and consequently the third collar slot does not have to be unduly enlarged.

Due to the arrangement of the slots and recesses along the length of the collar, the collar has a softer characteristic at its narrow end and, thus, has a more favorable dynamic behavior.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
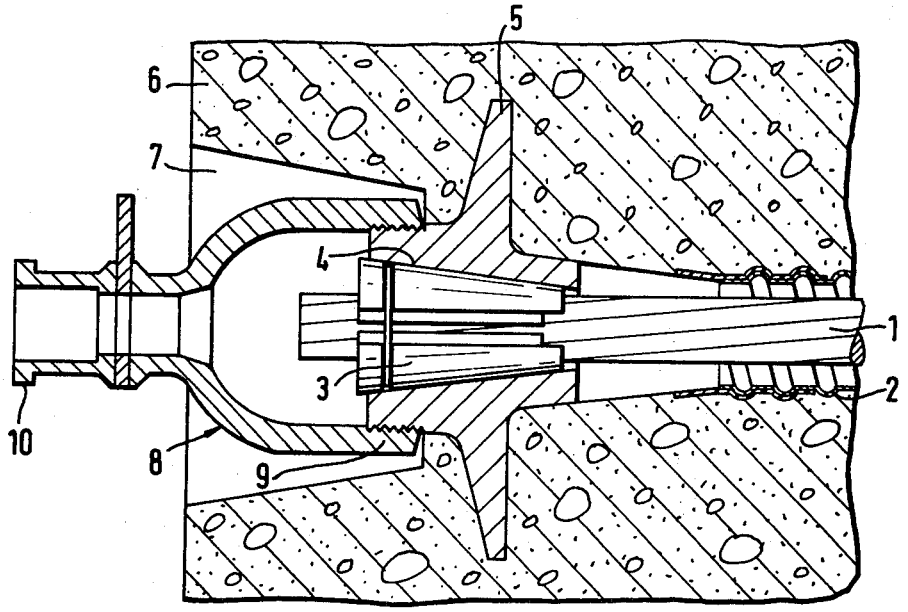
FIG. 1 is an axially extending sectional view through a tendon anchorage system during injection.

In the tendon anchorage system illustrated in FIG. 1 in axial section, a tendon or strand 1 extends through a guide tube 2 so that it retains its longitudinal or axial mobility. The strand 1 is anchored in the frusto-conical bore 4 of an anchoring member 5 by a three-part tapered collar 3. The anchoring member is at least partially encased in a structural concrete member 6. In the construction of the structural concrete member 6, a recess 7 is formed by a recess-forming piece, not shown, with the outer end of the anchoring member being exposed to the air where it projects into the recess 7. A jack can be inserted into the recess in engagement with the strand 1 for tensioning it and possibly for pressing the tapered collar 3 into the complementary shaped frusto-conical bore 4.

It is also possible to place an injection cap 8 into the recess so that it covers the outwardly directed end of the anchoring member 5. Cap 8 has an internal thread on its larger diameter end 9 which can be screwed on to a corresponding external thread formed in the outer surface of the anchoring member 5. The end of the injection cap 8 extending outwardly from the recess has a pipe 10 to which a hose can be connected for injecting material, such as neat cement or grout, around the tendon.

Figure 2:
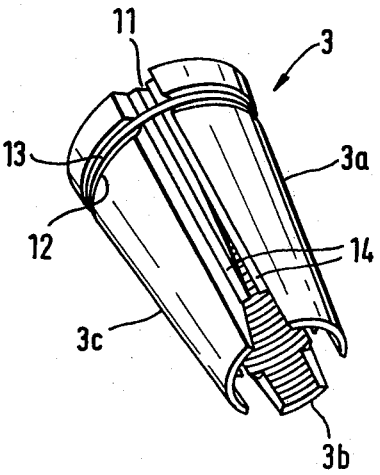
FIG. 2 is a perspective view of a tapered collar shown in FIG. 1 and embodying the present invention.

In FIG. 2, the tapered collar 3 is illustrated in a perspective view on a larger scale than in FIG. 1. The collar is made up of three individual axially extending parts **3*a*, 3*b* and 3*c* each of which extends angularly for about 120° and forms, with the exception of the narrow slots 11, a closed annular cross-section around the tendon. As can be seen in FIG. 2 the parts 3*a*, 3*b* and 3*c* are axially co-extensive and form a symmetrical arrangement. A circumferential groove 12 extends around the outer surface of the parts 3*a*, 3*b*, 3*c* adjacent the larger diameter end of the collar and a spring ring 13**, fitted into the groove, holds the parts together.

Figure 3:
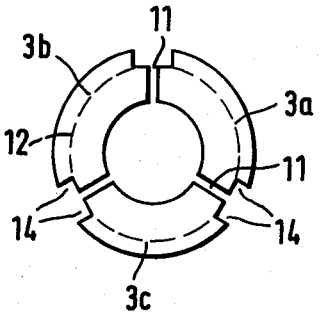
FIG. 3 is an end view of the larger diameter end of the tapered collar illustrated in FIG. 2.

As can be seen in the three figures, and especially in FIG. 3, the narrow slots 11 extend radially outwardly from the inner surface of the collar parts and open into groove-like recesses 14 formed in each of the adjacent edges of the adjoining parts. The recesses 14 extend inwardly from the outer surface of the collar and extend for a uniform depth along the axial length of the collar. The recesses 14, having a greater width than the slots 11, combine with the slots in forming a continuous axially extending groove along the axial length of the collar.

Since the thickness of the individual parts 3*a*, 3*b* and 3*c* is smaller, at the smaller diameter end of the tapered collar 3, than the depth of the recess 14, the portion of the parts containing the slots 11 terminate a short distance from the smaller diameter end of the collar. As a result, the cross-sectional area of each of the individual parts becomes gradually smaller toward the smaller diameter end of the collar and the collar becomes softer or more plastic. As a result, the smaller ends of the individual parts 3*a*, 3*b* and 3*c* can better follow the elastic expansion of the tendon under load, that is, the relative movement between the tendon and the tapered collar becomes smaller so that the behavior with respect to repetition of dynamic stress of the entire anchorage system is favorably influenced.

While specific embodiments of the invention have been shown and described in detail to illustrate the application of the inventive principles, it will be understood that the invnetion may be embodied otherwise without departing from such principles.

What is claimed is:

1. Multiple part tapered collar for use as a component of a wedge anchorage system for a tendon in a structural concrete unit, comprising a plurality of axially extending parts combining to form an axially extending annular collar said parts of said collar having an inner surface and an outer surface with the inner surrace arranged to bear against the tendon in the form of a wire, rod or the like and with the outer surface arranged to bear against the surface of a frusto-conically shaped bore in an anchoring member, wherein the improvement comprises that each of said parts have a first end and a second end with the outer surface thereof tapering inwardly from the first end to the second end, said parts combining to form longitudinal grooves extending in the axial direction of said collar for the axial length thereof between the first ends and second ends of said parts for forming a passage for the injection of neat cement or similar material around the tendon, said longitudinal grooves being formed in the outer surfaces of said parts of said collar and having a uniform depth for at least a major portion of the axial length thereof, each said part has a pair of axially extending edges in the assembled collar with a recess along the radially outer end of each said edge with the recess extending radially inwardly along the edge to a position intermediate the inner and outer ends of the edges, the recesses in adjoining edges of said parts forming said grooves.

2. Multiple part tapered collar, as set forth in claim 1, wherein the radially inner surfaces of said edges inwardly of said recesses form a slot extending along the inner surface of adjacent said parts with said slot opening into said longitudinal groove associated therewith and said slot having a smaller width than said longitudinal groove.

3. Multiple part tapered collar, as set forth in claim 1, wherein the inner surfaces of said parts form an axially extending cylindrical opening between the first and second ends thereof the thickness of said parts is reduced in the direction from the first to the second ends thereof with the thickness of said parts at the second ends beingless than the radial depth of said longitudinal grooves so that said longitudinal grooves open through the inner surface of said parts adjacent the second ends thereof.

* * * * *